US007695254B2

(12) United States Patent
Asai

(10) Patent No.: US 7,695,254 B2
(45) Date of Patent: Apr. 13, 2010

(54) ELECTRIC PUMP WITH COUPLED PRESSED MEMBERS

(75) Inventor: Yasuo Asai, Kashiwara (JP)

(73) Assignee: JTEKT Corporation, Osaka (JP)

( * ) Notice: Subject to any disclaimer, the term of this patent is extended or adjusted under 35 U.S.C. 154(b) by 0 days.

(21) Appl. No.: 11/878,130

(22) Filed: Jul. 20, 2007

(65) Prior Publication Data

US 2008/0019856 A1 Jan. 24, 2008

(30) Foreign Application Priority Data

Jul. 21, 2006 (JP) ..... P2006-199315

(51) Int. Cl.
*F04B 17/00* (2006.01)
*F04B 35/04* (2006.01)

(52) U.S. Cl. ..... 417/410.4; 418/171; 417/410.3; 310/88; 310/89; 310/90

(58) Field of Classification Search ..... 418/166, 418/171; 310/88, 89, 90; 417/410.3, 410.4
See application file for complete search history.

(56) References Cited

U.S. PATENT DOCUMENTS 3,552,888 A * 1/1971 Ericksson ..... 417/423.11
4,127,365 A * 11/1978 Martin et al. ..... 417/410.4
4,540,347 A * 9/1985 Child ..... 418/171
6,179,580 B1 * 1/2001 Huber et al. ..... 417/360
6,644,942 B2 * 11/2003 Rival et al. ..... 417/410.4
2006/0159567 A1 * 7/2006 Tazoe et al. ..... 417/410.3

FOREIGN PATENT DOCUMENTS

JP 2005-337025 12/2005

* cited by examiner

*Primary Examiner*—Theresa Trieu
(74) *Attorney, Agent, or Firm*—McGinn IP Law Group, PLLC

(57) ABSTRACT

A pump case of an electric pump is constructed by coupling a first pressed member formed with a cylindrical part for holding a first rolling ball bearing rotatably supporting a rotary shaft, and a second pressed member formed with a recess for receiving an inner rotor provided at a tip end of the rotary shaft to each other. Because the first pressed member and the second pressed member are formed by deep-drawing work, it is possible to achieve simplification of the structure and reduction of the cost, as compared with the pump case which has been produced from an aluminum die casting or the like, as in the related art.

19 Claims, 4 Drawing Sheets

ELECTRIC PUMP WITH COUPLED PRESSED MEMBERS

BACKGROUND OF THE INVENTION

The present invention relates to an electric pump which is driven by a motor.

Recently, for the purpose of reducing loads on the environment, attention has been paid to an electric vehicle which is driven by outputs of a motor, and a hybrid vehicle which is driven by outputs of an engine and a motor. These vehicles are so constructed that a pump for transmission and the like which has been conventionally driven by an engine may be driven by an electric motor, because the engine is not mounted or not always actuated even though the engine is mounted. As the electric pump of this type, an electric pump in which a rotor of a trochoid pump is rotated by an electric motor has been known, as disclosed in JP-A-2005-337025

FIG. 4 is a sectional view showing a structure of the conventional electric pump of this type. The electric pump includes a motor portion 60 for driving a rotary shaft 61, and a pump section 70 composed of a pump case 71 and a pump plate 72. The pump case 71 is formed with a through hole 71*a* for passing the rotary shaft 61 therethrough. In addition, a holding portion 71*b* for holding a bearing member 62 which rotatably holds the rotary shaft 61 is formed on one side surface of the pump case 71, and a recess 71*c* for receiving an inner rotor 63 which is provided at a tip end of the rotary shaft 61 is formed on the other side face of the pump case 71. The pump plate 72 is arranged so as to cover the recess 71*c* of the pump case 71. When the rotary shaft 61 is driven to rotate by the motor portion 60, the inner rotor is rotated in the recess 71*c*, whereby oil introduced into the recess 71*c* is compressed, and the oil is supplied from the electric pump under pressure. In this manner, in the hybrid vehicle or the like, the pump is constructed by substituting an electric motor for a drive source for the rotor in the trochoid pump which has been conventionally driven by an engine.

By the way, the pump case 71 constituting the electric pump as described above has been produced by mechanical work with high precision from an aluminum die casting or a cast product as material, for the purpose of preventing leakage of liquid from the recess 71*c* and for the purpose of supporting the rotary shaft 61 accurately. For this reason, the pump case has become complicated in structure and high cost, and therefore, it has been desired to simplify the structure and reduce the cost. Moreover, among the electric pumps as described above, there are some pumps in which high pressure is required, such as the pump for transmission, and there are some other pumps which are used in a low pressure region, such as the electric pump for cooling the motor in the hybrid vehicle or the like. In the electric pumps which are used in the low pressure region, use of the pump case having high precision as described above is beyond a required level of sealing performance or so. Therefore, it has been particularly desired to simplify the structure of the pump case and reduce the cost.

SUMMARY OF THE INVENTION

The invention has been made in view of the above described circumstances, and an object of the invention is to provide an electric pump in which simplification of a structure of a pump case and reduction of cost can be achieved.

In order to attain the above described object, the invention provides the following arrangements.

(1) An electric pump comprising:

a motor portion for driving a rotary shaft;

a pump case including:

a first pressed member that includes a through hole through which the rotary shaft is passed and a holding portion for holding a bearing member rotatably supporting the rotary shaft; and a second pressed member that includes a recess for receiving a rotor provided at a tip end of the rotary shaft; and a pump plate that covers the recess, wherein the first pressed member is coupled to the second pressed member.

(2) The electric pump according to (1) further comprising a liquid-tight packing interposed between the first pressed member and the second pressed member.

(3) The electric pump according to (1), wherein the holding portion of the first pressed member is formed in a cylindrical shape, a seal member for preventing liquid in the recess from intruding into the motor portion is press-fitted to an inner periphery of the holding portion, and the bearing member is secured and supported by the holding portion by caulking an end portion of the holding portion.

(4) The electric pump according to (1), wherein the second pressed member is integrally formed with a bracket for securing and supporting the electric pump.

(5) The electric pump according to (1), wherein the first pressed member is integrally formed with a motor case which contains the motor portion.

(6) The electric pump according to (1), wherein the first pressed member and the second pressed member are formed by deep-drawing work.

According to the invention, the pump case of the electric pump is constructed by coupling the first pressed member formed with the holding portion for holding the bearing member which rotatably supports the rotary shaft, and the second pressed member formed with the recess for receiving the rotor which is provided at the tip end of the rotary shaft to each other, and hence, it is possible to achieve simplification of the structure and reduction of the cost. Specifically, because the expensive pump case which has been produced by mechanical work with high precision from an aluminum die casting or a cast product as the material as in the related art is constructing by coupling the two pressed members to each other, simplification of the structure and reduction of the cost can be achieved. Moreover, useless wall thickness of the pump case can be saved by substituting the pressed members for the aluminum die casting or the cast product, and hence, weight reduction can be achieved. The structure of the pump case employing the pressed members can be favorably utilized in the electric pump in which a level of working precision required for the pump case in not so high, for example, the electric pump which is used in the low pressure region, such as the electric pump for cooling the motor in the hybrid vehicle or the like.

According to the invention, because the first pressed member and the second pressed member are coupled to each other, interposing the liquid-tight packing, it is possible to prevent liquid in the recess from leaking through a coupled part between the first pressed member and the second pressed member.

According to the invention, because the holding portion of the first pressed member is formed in a cylindrical shape, and the seal member for preventing liquid in the recess from intruding into the motor portion is press-fitted to the inner periphery of the holding portion, and the bearing member is secured and supported by caulking the end portion of the holding portion, it is possible to construct the first pressed member as a housing in which the seal member and the bearing member are unitized. As the results, it becomes easy to deal with the electric pump in its assembling steps, because the aforesaid members are unitized.

According to the invention, because the second pressed member is integrally formed with the bracket for securing and supporting the electric pump, there is no necessity of attaching a bracket member which has been separately provided to the pump plate or the pump case. As the results, it is possible to reduce the number of components and assembling steps, whereby the production cost can be reduced.

According to the invention, the first pressed member is integrally formed with the motor case which contains the motor portion of the electric pump. Therefore, because the motor case which is generally formed of a pressed member is integrally formed with the first pressed member, it is possible to reduce the number of components and the production cost.

According to the invention, the pump case of the electric pump is constructed by coupling the first pressed member formed with the holding portion for holding the bearing member which rotatably supports the rotary shaft, and the second pressed member formed with the recess for receiving the rotor which is provided at the tip end of the rotary shaft to each other. Therefore, it is possible to achieve simplification of the structure, reduction of the weight, and reduction of the cost, without using the expensive pump case which has been produced by mechanical work with high precision from an aluminum die casting or a cast product as the material, as in the related art.

DESCRIPTION OF PREFERRED EMBODIMENTS

First Embodiment

Figure 1:
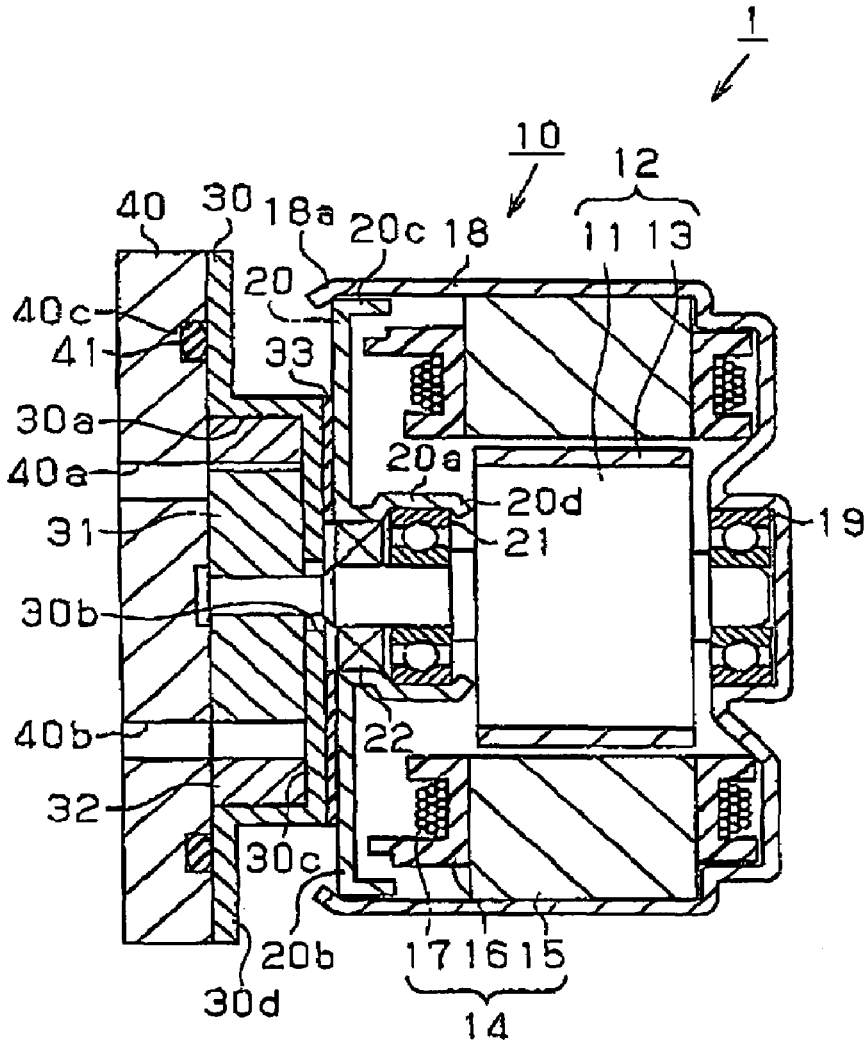
FIG. 1 is a sectional view showing a structure of an electric pump in a first embodiment according to the invention.
Figure 2:
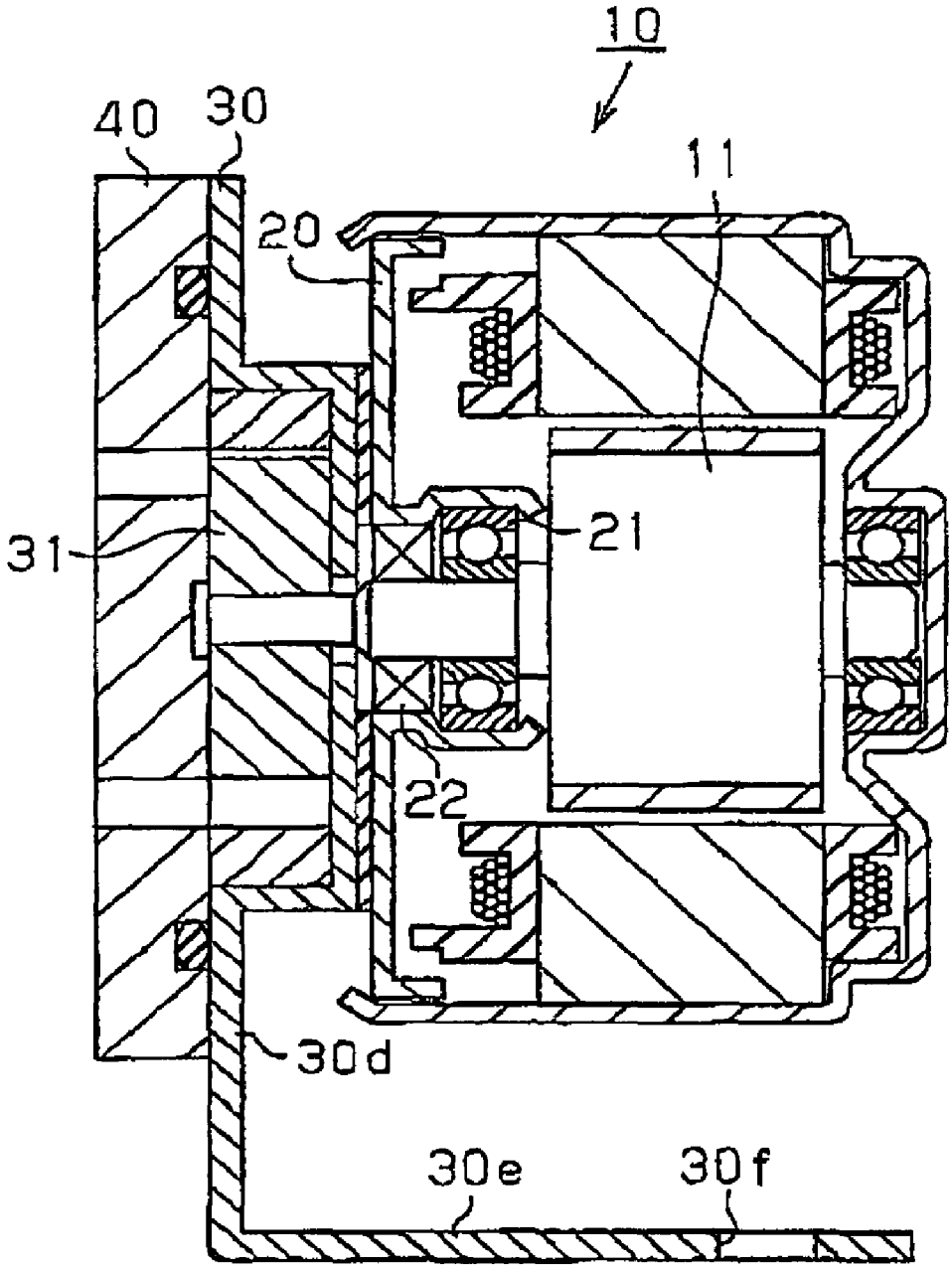
FIG. 2 is a sectional view showing the structure in case where a bracket is integrally formed on a second pressed member.

Now, referring to FIGS. 1 and 2, an electric pump according to a first embodiment of the invention will be described. FIG. 1 is a sectional view showing a structure of an electric pump in the first embodiment. This electric pump 1 is a hydraulic pump for driving a trochoid pump which is a kind of an internal gear pump.

Figure 4:
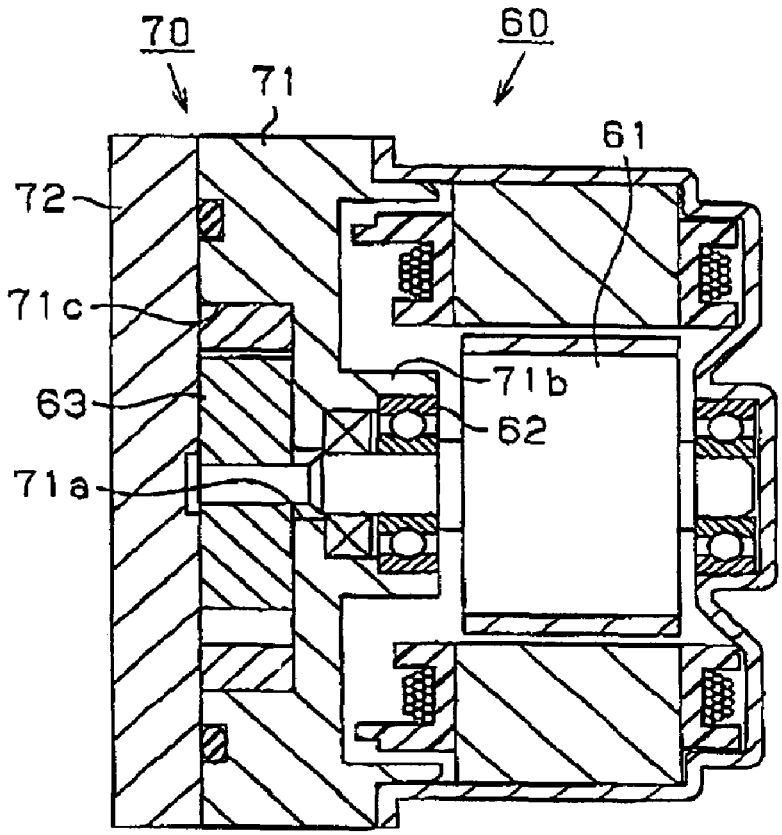
FIG. 4 is a sectional view showing a structure of an electric pump in a conventional case.

The electric pump 1 includes a motor portion 10 for driving a rotary shaft 11, a first pressed member 20 for holding a first rolling ball bearing (bearing member) 21 which rotatably supports the rotary shaft 11, a second pressed member 30 formed with a recess 30*a* for receiving an inner rotor 31 of the trochoid pump, and a pump plate 40 for covering the recess 30*a*. According to the present invention, the pump case which has been produced by mechanical work from an aluminum die casting or a cast product as material, in the conventional electric pump as shown in FIG. 4, is constructed by coupling the first pressed member 20 and the second pressed member 30 to each other.

The motor portion 10 includes a motor rotor 12 having the rotary shaft 11, and a motor stator 14 which is provided on an outer periphery of the motor rotor 12. The motor rotor 12 has a permanent magnet 13 in a cylindrical shape fixed to an outer periphery of the rotary shaft 11. The motor stator 14 includes a stator core 15 having a plurality of teeth, and a coil 17 which is wound around the stator core 15 with interposing an insulator 16. The above described motor portion 10 is contained in a motor case 18. The rotary shaft 11 is rotatably supported by the first rolling ball bearing 21 which is held by the first pressed member 20 and the second rolling ball bearing 19 which is held by the motor case 18.

The first pressed member 20 is formed of a metal plate and produced by deep-drawing work. The first pressed member 20 has a cylindrical part 20*a* which is formed in its center part, a flat part 20*b* opposed to the second pressed member 30, and a spigot joint part 20*c* which is cylindrically formed on its outer circumference. A seal member 22 in an annular shape for preventing oil in the recess 30*a* of the second pressed member 30 from intruding into the motor portion 10 is press-fitted to an inner periphery of the cylindrical part 20*a* as the holding portion, and the first rolling ball bearing 21 is secured and supported, by caulking an end portion 20*d* of the cylindrical part 20*a*. An end portion 18*a* of the motor case 18 is coupled to the spigot joint part 20*c* by caulking.

The second pressed member 30 is formed of a metal plate and produced by deep-drawing work, in the same manner as the first pressed member 20. The second pressed member 30 has the recess 30*a* which contains the inner rotor 31, a through hole 30*b* formed in its center part, a flat part 30*c* opposed to the flat part 20*b* of the first pressed member 20, and a flat part 30*d* opposed to the pump plate 40. An outer rotor 32 in mesh with the inner rotor 31 is provided on an inner periphery of the recess 30*a*. The outer rotor 32 is provided having its rotation center offset from a rotation center of the inner rotor 31, and has the number of teeth which is larger than the number of teeth of the inner rotor 31. An outer periphery of the outer rotor 32 is rotatably supported by the inner peripheral face of the recess 30*a*. The rotary shaft 11 of the motor portion 10 is passed through the through hole 30*b*. The inner rotor 31 is fixed to the tip end of the rotary shaft 11, whereby the inner rotor 31 will be driven to rotate.

A liquid-tight packing 33 formed of paper packing or the like is interposed between the flat part 20*b* of the first pressed member 20 and the flat part 30*c* of the second pressed member 30. The flat part 20*b* and the flat part 30*c* are coupled together by spot welding. The first pressed member 20 and the second pressed member 30 are coupled to each other in this manner, whereby the oil in the recess 30*a* is prevented from leaking through a coupled part between the first pressed member 20 and the second pressed member 30.

The pump plate 40 is formed in a plate-like shape, and has a suction port 40*a* for sucking the oil into the recess 30*a*, a discharge port 40*b* for discharging the oil from the recess 30*a*, and a groove 40*c* in which an O-ring 41 is fitted. The suction port 40*a* and the discharge port 40*b* are formed in the pump plate 40 in a manner of passing it through. The groove 40*c* is formed so as to be opposed to the flat part 30*d* of the second pressed member 30, and the oil is prevented from leaking through a gap between the pump plate 40 and the second pressed member 30 by the O-ring 41 which has been fitted in the groove.

In the electric pump 1 having the above described structure, a bracket for securing and supporting the electric pump 1 may be integrally formed with the second pressed member 30. FIG. 2 is a sectional view showing the structure in which the second pressed member 30 has a bracket part 30*e*. The bracket part 30*e* is formed by extending a part of the flat part 30*d* of the second pressed member 30 in an outer circumferential direction. Then, the electric pump 1 will be fixed to a desired position by securing it with a screw using a hole 30*f* which is formed in the bracket part 30*e*. In this case, it is also possible to form a vibration insulator or the like for moderating transmission of vibration of the electric pump 1 integrally with the bracket part 30*e*.

Then, operation of the electric 1 will be described. This electric pump 1 will be operated, when electric current to the coil 17 of the motor stator 14 is supplied and controlled by a control device which is not shown. When the electric current has been supplied to the coil 17, the motor rotor 12 is rotated, and in association with this rotation, the inner rotor 31 fixed to the rotary shaft 11 is rotated. As the inner rotor 31 is rotated, the outer rotor 32 in mesh with the inner rotor 31 is also rotated. Since the number of the teeth of the inner rotor 31 is smaller than the number of the teeth of the outer rotor 32, the outer rotor 32 will rotate with the smaller rotation number than the inner rotor 31. For this reason, while the inner rotor makes one rotation, a position and a capacity of a space which is formed between the inner rotor 31 and the outer rotor 32 will be sequentially displaced. When the capacity has become larger, the pressure is lowered so as to suck the oil from the suction port 40*a*, and when the capacity has become smaller, the pressure is increased so as to push out the oil from the discharge port 40*b*. In this manner, pumping action is generated between the inner rotor 31 and the outer rotor 32, whereby the oil is supplied from the electric pump 1 under pressure.

According to the electric pump in the above described first embodiment, the following advantages can be obtained.

(1) In the first embodiment, the pump case of the electric pump 1 is constructed by coupling the first pressed member 20 having the cylindrical part 20*a* for holding the first rolling ball bearing 21 which rotatably supports the rotary shaft 11, and the second pressed member 30 in which the recess 30*a* for receiving the inner rotor 31 which is provided at the tip end of the rotary shaft 11 to each other. As described, because the pump case is constructed by coupling the first pressed member 20 and the second pressed member 30 which have been formed by deep-drawing work to each other, it is possible to simplify the structure and to reduce the cost, as compared with the expensive pump case in the related art which has been produced by mechanical work with high precision employing an aluminum die casting or a cast product as the material. Moreover, because the pump case is composed of the pressed members 20 and 30, useless thickness of the pump case can be saved, and weight reduction can be achieved. The structure of the pump case employing the pressed members 20, 30 can be favorably utilized in the electric pump in which a level of working precision required for the pump case in not so high, for example, the electric pump which is used in the low pressure region of about 0.1 MPa, such as the electric pump for cooling the motor in the hybrid vehicle or the like.

(2) In the first embodiment, the first pressed member 20 and the second pressed member 30 are coupled together with interposing the liquid-tight packing 33 between the flat part 20*b* and the flat part 30*c*. As the results, it is possible to prevent the pressure of the oil supplied from the electric pump 1 from being lowered due to leakage of the oil in the recess 30*a* through the coupled part between the first pressed member 20 and the second pressed member 30.

(3) In the first embodiment, the seal member 22 is press-fitted to the inner periphery of the cylindrical part 20*a* of the first pressed member 20, and the first rolling ball bearing 21 is secured and supported by caulking the end portion 20*d* of the cylindrical part 20*a*. As the results, it is possible to construct the first pressed member 20 as a housing in which the seal member 22 and the first rolling ball bearing 21 are unitized, and hence, the electric pump 1 can be easily handled in its assembling step.

(4) In the first embodiment, it is possible to form the bracket for securing and supporting the electric pump 1 integrally with the second pressed member 30. By providing the bracket part 30*e* on the second pressed member 30, there is no necessity of providing a bracket member which has been separately attached to the pump plate 40 or the like in the prior case. As the results, the number of components can be reduced and the assembling steps can be shortened, whereby the production cost can be reduced.

Second Embodiment

Now, referring to FIG. 3, a second embodiment of the electric pump according to the invention will be described. Although an internal structure of the electric pump in the second embodiment is substantially the same as in the first embodiment, the second embodiment is different from the first embodiment only in the structure of the first pressed member. It is to be noted that in the following description of the second embodiment, the same constituent elements as in the first embodiment will be denoted with the same reference numerals, and overlapped descriptions will be omitted or simplified.

Figure 3:
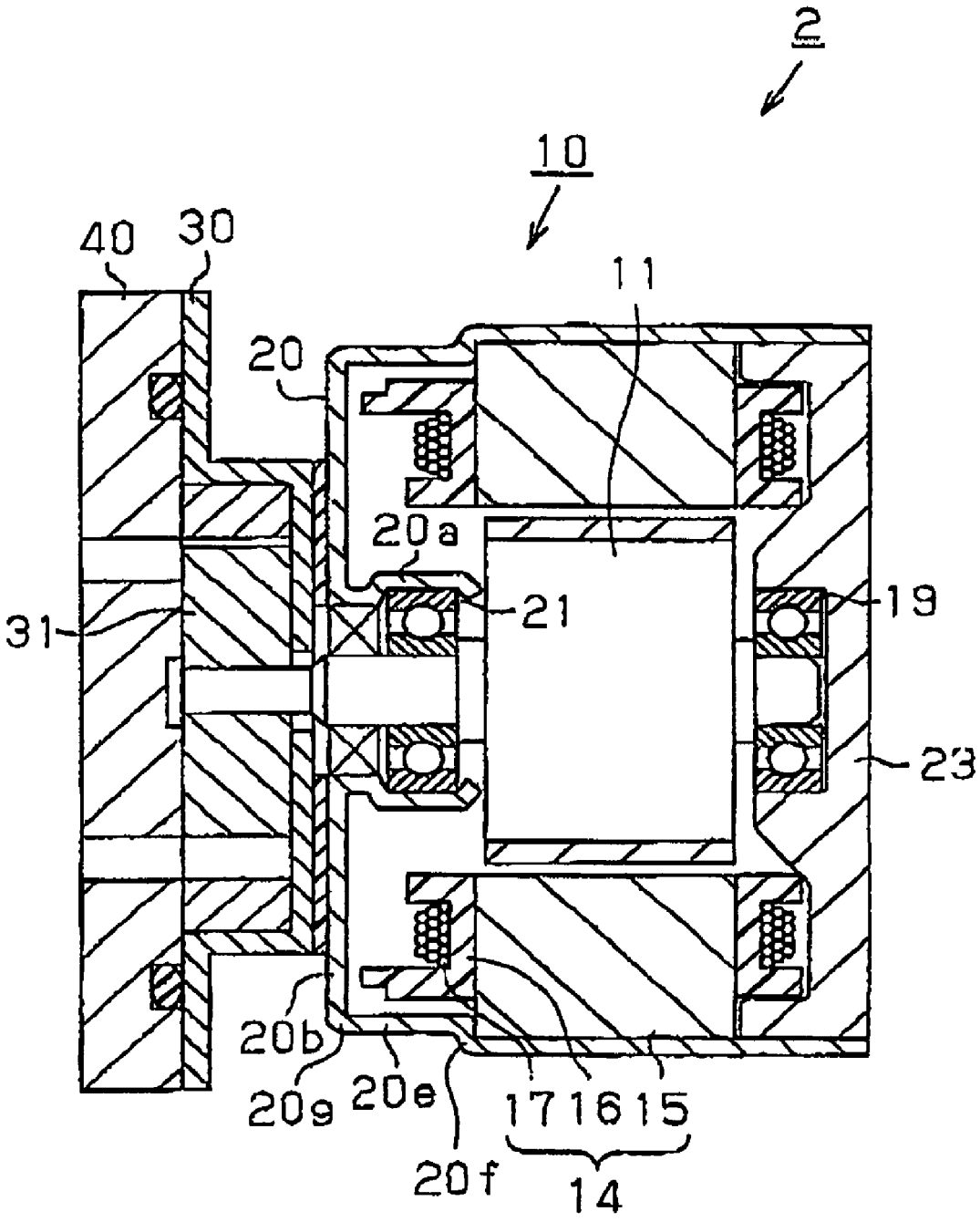
FIG. 3 is a sectional view showing a structure of an electric pump in a second embodiment.

FIG. 3 is a sectional view showing a structure of an electric pump 2 in the second embodiment. The first pressed member 20 of the electric pump 2 is formed integrally with the motor case which contains the motor portion 10. The first pressed member 20 includes the cylindrical part 20*a* formed in its center part, the flat part 20*b* opposed to the second pressed member 30, and a motor case part 20*e* which is extended in a cylindrical shape from an outer circumference of the flat part 20*b*. The motor case part 20*e* is provided with a stepped part 20*f* for holding the stator core 15 of the motor stator 14. Moreover, the second rolling ball bearing 19 which rotatably supports the rotary shaft 11 is secured and supported by a cover member 23 for covering the motor portion 10. It is to be noted that bending work may be applied to positions where rigidity is required, such as a corner area 20*g* between the flat part 20*b* and the motor case part 20*e*, thereby to secure the rigidity.

According to the electric pump in the above described second embodiment, in addition to the advantages (1) to (3) in the first embodiment, the following advantages can be obtained.

(5) In the second embodiment, the motor case part 20*e* which contains the motor portion 10 of the electric pump 2 is integrally formed with the first pressed member 20. Therefore, by integrally forming the motor case which is generally formed of a pressed member, it is possible to reduce the number of components and the production cost.

Further, the above described embodiments can be modified as follows;

Although the invention is applied to the electric pumps 1, 2 for driving the trochoid pump in the first and second embodiments, it is also possible to apply the invention to an electric pump for driving other internal gear pumps besides the trochoid pump.

Although the first pressed member 20 and the second pressed member 30 are coupled together by spot welding in the first and second embodiments, it is also possible to couple the first pressed member 20 and the second pressed member by other means such as caulking.

Although the electric pumps 1, 2 are hydraulic pumps for supplying oil under pressure in the first and second embodiments, it is also possible to apply the invention to an electric pump for supplying other liquid than oil, such as water.

Although the bearing member for rotatably supporting the rotary shaft 11 is the rolling ball bearings 19, 21 in the first and second embodiments, the bearing member may include a roller bearing, or other bearings than the rolling bearing.

The structures of the electric pumps 1, 2 in the first and second embodiments can be favorably utilized in the electric pump to be used in the low pressure region. However, the structures of the electric pumps 1, 2 may be utilized in the electric pump to be used in the higher pressure region, depending on precision of the pressing work of the first pressed member 20 and the second pressing member 30. Specifically, in case where the precision of the stamping work of the pressed members 20, 30 can be improved, the sealing performance or the like can be enhanced, and therefore, it is possible to apply the structure of the invention to the electric pump to be used in the higher pressure region.

What is claimed is:

1. An electric pump, comprising:

a motor portion for driving a rotary shaft;

a pump case including:

a first pressed member that includes a through hole through which the rotary shaft is passed and a holding portion for holding a bearing member rotatably supporting the rotary shaft; and a second pressed member that includes a recess for receiving a rotor provided at a tip end of the rotary shaft; and a pump plate that covers the recess, said pump plate having a plate shape and comprising:

a suction port for sucking oil into the recess;

a discharge port for discharging oil from the recess; and a groove in which an O-ring is fitted, wherein the first pressed member is coupled to the second pressed member.

2. The electric pump according to claim 1, further comprising a liquid-tight packing interposed between the first pressed member and the second pressed member.

3. The electric pump according to claim 1, wherein the holding portion of the first pressed member is formed in a cylindrical shape, a seal member for preventing liquid in the recess from intruding into the motor portion is press-fitted to an inner periphery of the holding portion, and the bearing member is secured and supported by the holding portion by caulking an end portion of the holding portion.

4. The electric pump according to claim 1, wherein the second pressed member is integrally formed with a bracket for securing and supporting the electric pump.

5. The electric pump according to claim 1, wherein the first pressed member is integrally formed with a motor case which contains the motor portion.

6. The electric pump according to claim 1, wherein the first pressed member and the second pressed member are formed by deep-drawing work.

7. The electric pump according to claim 1, wherein a seal member is press-fitted to an inner periphery of a cylindrical part of the holding portion in an annular shape for preventing oil in the recess of the second pressed member from intruding into the motor portion.

8. The electric pump according to claim 1, wherein the bearing member is secured and supported by caulking an end portion of the holding portion.

9. The electric pump according to claim 1, wherein an entire coupling area between the first pressed member and the second pressed member comprises a liquid-tight packing that is interposed between a flat part of the first pressed member and a flat part of the second pressed member.

10. The electric pump according to claim 1, wherein an entire coupling area between the first pressed member and the second pressed member only comprises a liquid-tight paper packing that is interposed between the first pressed member and the second pressed member.

11. The electric pump according to claim 1, wherein the first pressed member is spot welded to the second pressed member.

12. The electric pump according to claim 1, wherein the first pressed member further comprises a spigot joint part which is cylindrically formed on its outer circumference.

13. The electric pump according to claim 12, wherein an end portion of a motor case, which contains the motor portion, is coupled to the spigot joint part by caulking.

14. The electric pump according to claim 1, wherein the second pressed member comprises a flat part, which is orthogonal to an axis of rotation of said rotary shaft, in contact with the pump plate.

15. The electric pump according to claim 1, wherein the pump plate comprises a flat surface which covers the rotor and an end surface of said tip end of the rotary shaft.

16. The electric pump according to claim 1, wherein an outer rotor in mesh with said rotor is provided on an inner periphery of the recess, and wherein an outer periphery of the outer rotor is rotatably supported by an inner peripheral face of the recess.

17. The electric pump according to claim 1, wherein the first pressed member and the second pressed member comprise a metal plate.

18. A pump case of an electric pump, said pump case comprising:

a first pressed member that comprises a through hole through which a rotary shaft is passed and a holding portion for holding a bearing member rotatably supporting the rotary shaft; and a second pressed member that comprises a recess for receiving a rotor provided at a tip end of the rotary shaft, wherein a pump plate, which comprises a flat surface that covers the rotor and an end surface of said tip end of the rotary shaft, covers the recess, said pump plate having a plate shape and comprising:

a suction port for sucking oil into the recess;

a discharge port for discharging oil from the recess; and a groove in which an O-ring is fitted, wherein the first pressed member is spot welded to the second pressed member, and wherein an entire coupling area between the first pressed member and the second pressed member only comprises a liquid-tight packing that is interposed between the first pressed member and the second pressed member.

19. An electric pump comprising:

a motor portion for driving a rotary shaft;

a pump case including:

a first pressed member that comprises a through hole through which the rotary shaft is passed and a holding portion for holding a bearing member; and a second pressed member that comprises a recess for receiving a rotor provided at a tip end of the rotary shaft; and a pump plate, which comprises a flat surface that covers the rotor and an end surface of said tip end of the rotary shaft, that covers the recess, wherein the first pressed member is spot welded to the second pressed member, wherein an entire coupling area between the first pressed member and the second pressed member only comprises a liquid-tight packing that is interposed between the first pressed member and the second pressed member, wherein the second pressed member is integrally formed with a bracket for securing and supporting the electric pump, wherein the second pressed member comprises a flat part, which is orthogonal to an axis of rotation of said rotary shaft, in contact with the pump plate, wherein a seal member is press-fitted to an inner periphery of a cylindrical part of the holding portion in an annular shape for preventing oil in the recess of the second pressed member from intruding into the motor portion, and wherein an outer rotor in mesh with said rotor is provided on an inner periphery of the recess.

* * * * *